United States Patent [19]

Sturdevant et al.

[11] Patent Number: 4,558,208

[45] Date of Patent: Dec. 10, 1985

[54] HEATING STRUCTURE FOR AN OVEN

[75] Inventors: Eugene J. Sturdevant, Wilmington, Del.; John F. Daniels, Paoli, Pa.

[73] Assignee: Harry Hill Associates, Philadelphia, Pa.

[21] Appl. No.: 493,936

[22] Filed: May 12, 1983

[51] Int. Cl.[4] ..... H01T 19/04

[52] U.S. Cl. ..... 219/399; 165/96; 361/229; 250/326; 219/402; 219/404

[58] Field of Search ..... 219/399, 392, 402, 404, 219/10.81, 391, 394, 395, 396, 397, 398, 403, 280, 281; 165/1, 96; 174/16 R; 361/229, 230; 264/22, 25, 26, 27; 250/324, 325, 326; 422/186.04; 425/174.4, 174.6, 174.8 E, 174.8 R

[56] References Cited

U.S. PATENT DOCUMENTS

| | | | |
|---|---|---|---|
| 2,415,768 | 2/1947 | Shaw | 219/402 |
| 2,871,315 | 1/1959 | Lindsay | 219/385 |
| 3,526,268 | 9/1970 | Robinson | 219/391 |
| 3,872,917 | 3/1975 | Blomgren | 165/1 |
| 4,092,390 | 5/1978 | Mulvany | 425/174.4 |
| 4,238,668 | 12/1980 | Mammen | 165/96 |

*Primary Examiner*—C. L. Albritton
*Assistant Examiner*—Teresa J. Walberg
*Attorney, Agent, or Firm*—Dann, Dorfman, Herrell and Skillman

[57] ABSTRACT

A cooking oven has an enhanced heating structure for decreasing the cooking time relative to conventional ovens. The enhanced heating structure located on the bottom of the oven has a plurality of spaced apart upward projecting needle electrodes and a heater element located adjacent the needle electrodes. A frame and a flat plate form an enclosure of selected volume for enclosing the needle electrodes and the heater element. The flat plate supports the food for cooking and provides safety and ease of cleaning for the user. An electrical circuit generates a high voltage between the flat plate and the needle electrodes for increasing the rate of heat transfer from the heater element to the flat plate. The temperature of the selected volume enclosed is separately monitored and independently controlled.

10 Claims, 5 Drawing Figures

HEATING STRUCTURE FOR AN OVEN

BACKGROUND OF THE INVENTION

The present invention relates to cooking ovens and more particularly to an enhanced heating structure for decreasing the cooking time.

An embodiment of an enhanced heating structure from decreasing cooking time is disclosed in a copending application entitled Enhanced Heat and Mass Transfer Apparatus, U.S. Ser. No. 448,556, filed 4/25/83, and having the same assignee.

A cooking oven with a heating structure for decreasing cooking time is disclosed in U.S. Pat. No. 4,238,688 issued to H. W. Mammen on Dec. 9, 1980. This patent discloses a rack or tray for supporting the food and a heating element mounted in the oven below the food and discloses a field grid element and a heating element mounted in the oven above the food. The rack or tray below the food participates with the field grid element above the food for generating an electrical field to decrease the cooking time. A disadvantage of this heating structure is that this structure is not capable of generating an electrical field below the food independent of the heating structure above the food thereby restricting the decreased cooking time.

SUMMARY OF THE INVENTION

In the illustrated embodiment of the present invention, there is shown a cooking oven having an enhanced heating structure on the bottom thereof for decreasing the cooking time relative to conventional cooking ovens. The enhanced heating structure has a plurality of spaced apart upward projecting needle electrodes supported on a platform and a heater element located adjacent the needle electrodes. A frame of electrical insulating material outlines the platform. A flat plate of heat and electrical conductive material, such as aluminum, is mounted on the frame to form an enclosure of selected volume for completely enclosing the needle electrodes and the heater element. The flat plate is located above and spaced from the needle electrodes and from the heater element. The flat plate supports the food for cooking and provides safety and ease of cleaning for the user.

The heater element is connected to an electrical power supply. A high voltage supply generates a high voltage field between the flat plate and the needle electrodes for increasing the rate of heat transfer from the heater element to the flat plate.

Accordingly, an object of the present invention is to provide an oven with an enhanced heating structure for decreasing cooking time.

Another object of the present invention is to provide an oven with an enhanced heating structure having a flat plate located above the needle electrodes to prevent the needle electrodes from injuring the user, to prevent the user from damaging the needle electrodes, and to provide a cooking surface which is easy to clean.

Another object of the present invention is to provide an independent temperature control for maintaining a desired temperature in the selected volume of the enhanced heating structure.

Another object of the present invention is to provide an oven with an enhanced heating structure below the food to cooperate with a heating structure above the food for heating the food substantially uniformly over its entire surface.

Other objects, features and advantages of the invention will become more apparent from the following description, including appended claims and accompanying drawing.

DESCRIPTION OF THE PREFERRED EMBODIMENT

Figure 1:
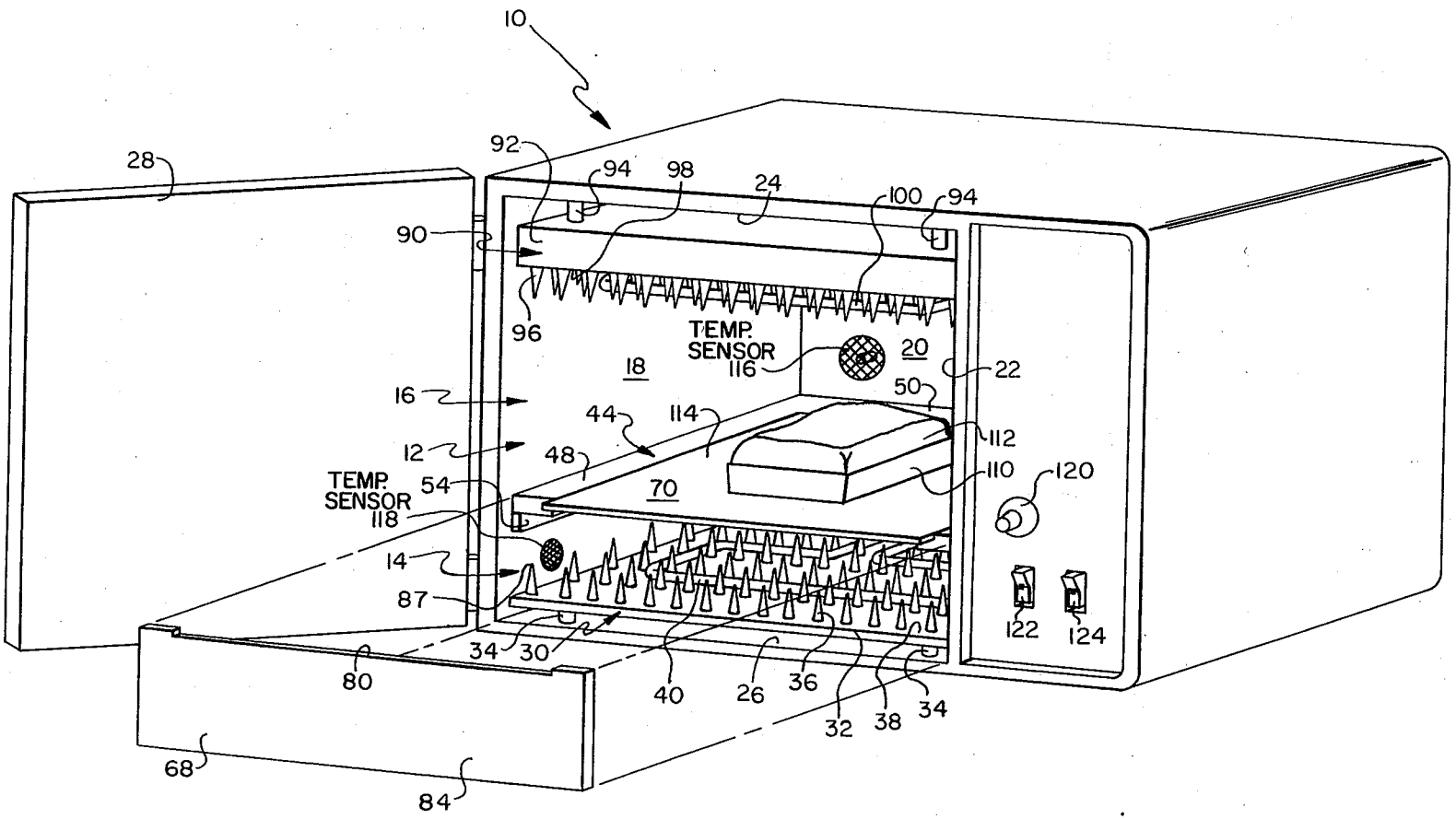
FIG. 1 is a front perspective view of the oven with the door open showing the enhanced heating structure made in accordance with the present invention.

Referring to FIG. 1, the oven 10 is designed to accept food items inside a heating cavity 12 comprised of a selected lower volume 14 and an upper volume 16. The heating cavity 12 is formed by a left side wall 18, a back wall 20, a right side wall 22, a top surface 24, a bottom surface 26 and a hinged door 28.

Figure 2:
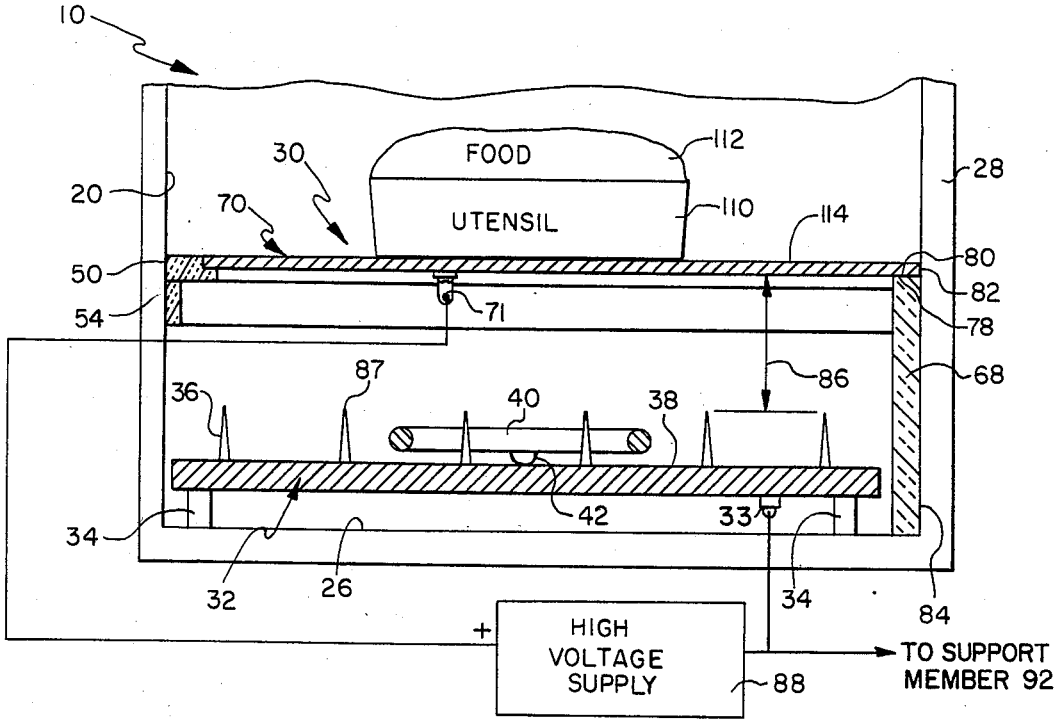
FIG. 2 is a left side elevational view partially in cross section of the enhanced heating structure.

Referring to FIGS. 1 and 2, a lower enhanced heating structure 30 forms the lower volume 14 of the heating cavity 12. The heating structure 30 has a platform 32 which includes legs 34 resting on the bottom surfaces 26 of the oven 10. The platform 32 is formed from an electrically conductive metal. A plurality of spaced apart needle electrodes 36 are rigidly mounted on the platform 32 by any suitable means such as an adhesive. The term "needle" is not means to suggest that the electrodes require a particular shape but that they require a pointed or small diameter tip suitable for corona generation. The needle electrodes 36 are formed from an electrically conductive metal. The needle electrodes 36 project upward a predetermined distance above the top surface 38 of the platform 32. The heater element 40 here located adjacent the needle electrodes 36 is rigidly attached to the platform 32 and slightly spaced above the surface 38 of the platform 32 by conventional legs 42.

Figure 3:
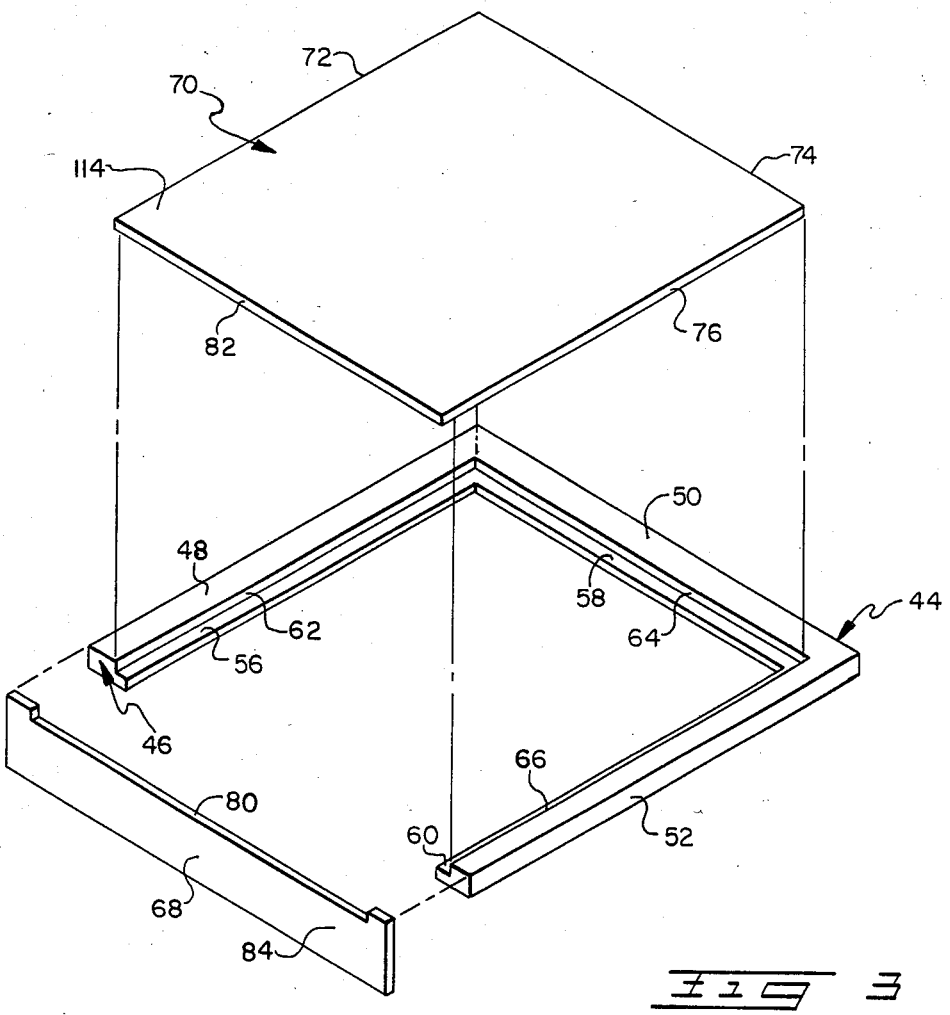
FIG. 3 is a front perspective exploded view of the frame and the flat plate.
Figure 4:
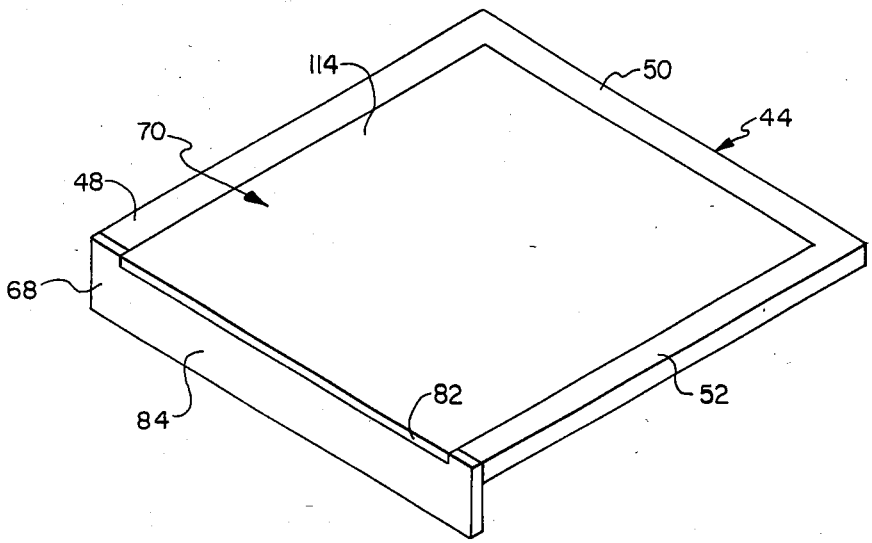
FIG. 4 is a front perspective assembled view of the frame and the flat plate.

Referring to FIGS. 1 and 3, a frame 44 has a step shaped ledge 46 formed on a left side section 48, a back section 50 and a right side section 52. A bar 54 is rigidly attached to the left side wall 18, the back wall 20 and the right side wall 22 by any suitable means such as screws. The bar 54 supports the frame 44 in the oven 10. The bar 54 is made from non-electrically conductive material such as ceramic. The ledge 46 has support surfaces 56, 58 and 60 on the respective sections 48, 50 and 52. The ledge 46 also has abutment walls 62, 64 and 66 on the respective sections 48, 50, and 52. The frame 44 includes a front wall 68 removably attached to the left side section 48 and to the right side section 52 by any suitable means such as screws. Alternatively, the frame 44 could be made from one solid piece such as a casting.

A flat plate 70 is mounted on the support surfaces 56, 58 and 60 and has three peripheral edges 72, 74 and 76 abutting against corresponding abutment walls 62, 64 and 66. A bottom surface 78 (FIG. 2) along the front of the flat plate 70 is supported on a top surface 80 of the front wall 68. A front edge 82 of the flat plate 70 is substantially flush with an outside surface 84 of the front wall 68. The flat plate 70 is rigidly attached to the frame 44 by any suitable means such as by screws (none shown). Alternatively, the flat plate 70 could be non-rigidly seated on the frame 44 and thereby could be readily removed for cleaning and replacement purposes. When the flat plate 70 is mounted on the frame 44, the flat plate 70 is located above and spaced from the needle electrodes 36 a predetermined distance indicated by line 86 extending between the free ends 87 of the electrodes 36 and the flat plate 70.

The frame 44 is made from a non-electrically conductive material such as ceramic. The flat plate 70 is made from an electrically conductive material such as aluminum. A high voltage supply 88 is electrically connected to the flat plate 70 by a connector 71. The other terminal of voltage supply 88 is preferably grounded and connected by connector 33 to conductive platform 32 to complete the circuit. A similar connection is made to support member 92. The frame 44 completely electrically isolates the flat plate 70 from the oven 10. The combination of the frame 44 and the flat plate 70 completely encloses the plurality of needle electrodes 36 and the heater element 40. The resulting enclosure forms the selected lower volume 14 and the remaining area of the cavity 12 becomes the upper volume 16.

Referring again to FIG. 1, an upper heating structure 90 is mounted in the upper volume 16 of the cavity 12. The heating structure 90 has a support member 92 attached either to the top surface 24 of the oven 10 by posts 94 or to a drive mechanism mounted on the oven which may move the upper heating structure 90 vertically as disclosed in the previously mentioned copending application. A plurality of spaced apart needle electrodes 96 are rigidly attached to the support member 92 by any suitable means such as by an adhesive. The support member 92 and the needle electrodes 96 are formed from an electrically conductive metal. The needle electrodes 96 project downward a predetermined distance from the lower surface 98 of the support member 92. The heater element here 100 located adjacent the needle electrodes 96 is rigidly attached to the support member 92 and slightly spaced below the surface 98 of the support member 92.

A utensil 110 carrying food 112 is conveniently and safely placed in the oven 10 by placing the utensil 110 on a top surface 114 of the flat plate 70. The enhanced heating structure 30 is located below the food 112 and the upper heating structure 90 is located above the food 112.

Referring to FIG. 1, an upper temperature sensor 116 is mounted in the back wall 20 for sensing the temperature in the upper volume 16 of the oven 10. A lower temperature sensor 118 is mounted in the left side wall 18 for sensing the temperature in the lower volume 14 of the oven 10. An oven temperature adjustable knob 120 is adjustable to set a desired temperature in the oven 10. The sensor 116 causes the heater element 100 to provide heat or not provide heat to maintain the temperature at the temperature setting of the adjustable knob 120 in the upper volume 16. The sensor 118 causes the heater element 40 to provide heat or not provide heat to maintain the temperature at the temperature setting of the adjustable knob 120 in the lower volume 14. An on-off switch 122 controls electrical power for the heater element 40 and the heater element 100. The oven 10 can be used as a conventional oven by operating the adjustable knob 120 and the on-off switch 122. A second on-off switch 124 controls electrical power for the enhanced heating structure 30.

Figure 5:
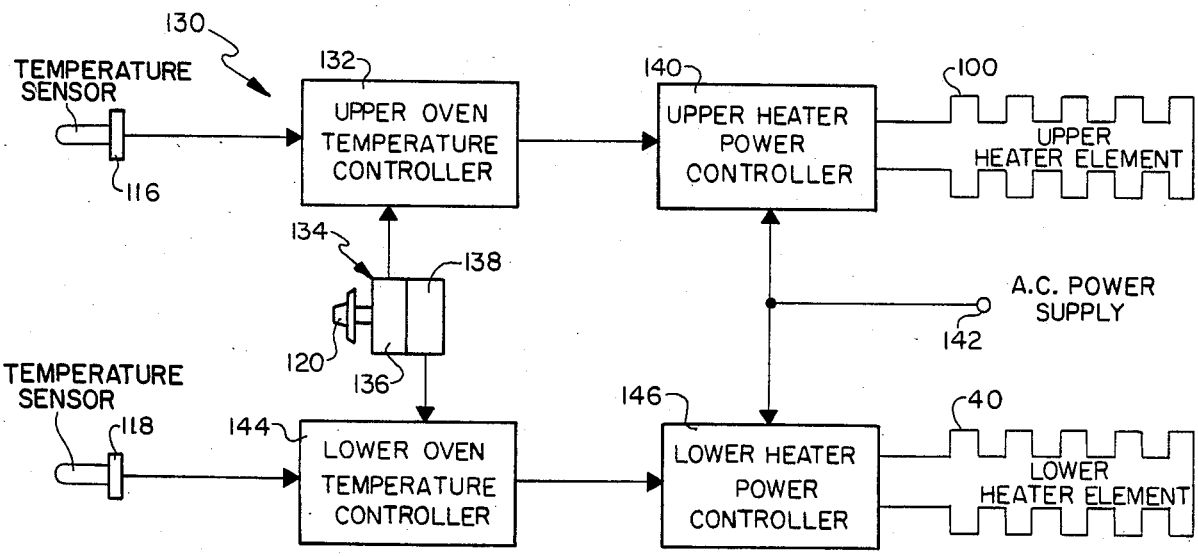
FIG. 5 is a block diagram of a temperature control system for the oven.

Referring to FIG. 5, an oven temperature control system 130 is operable to independently control the upper heating structure 90 and the enhanced heating structure 30 for providing heat according to the size of the upper volume 16 relative to the size of the lower volume 14 for heating the food substantially uniformly over its entire surface.

The upper temperature sensor 116 is connected to an upper oven temperature controller 132. The oven temperature adjustable knob 120 adjusts a dual control 134 consisting of a first potentiometer 136 and a second potentiometer 138. The first potentiometer 136 is connected to the temperature controller 132. The temperature controller 132 is connected to an upper heater power controller 140 which, in turn, is connected to the heater element 100. An A.C. power supply 142 is connected to the upper heater power controller 140.

The lower temperature sensor 118 is connected to a lower oven temperature controller 144. The second potentiometer 138 is connected to the temperature controller 144. The temperature controller 144 is connected to a lower heater power controller 146 which, in turn, is connected to the heater element 40. The A.C. power supply 142 is connected to the lower heater power controller 146.

One desired total wattage of the oven 10 is 1400 watts. The upper heater power controller 140 can be adapted to use a wattage selected from a range of 700 to 1050 watts. The lower heater power controller 146 can be adapted to use a wattage selected from a range of 350 to 700 watts such that a maximum of 1400 watts is available for the oven 10. Since the upper volume 16 has a larger area to heat than the lower volume 14, the higher range of 700 to 1050 watts is allocated for the upper volume 16.

When the adjusting knob 120 has been adjusted to a desirable temperature, the temperature sensor 116 will activate the upper oven temperature controller 132 to on and off conditions which, in turn, will activate the upper heater power controller 140 to on and off conditions. When activated, the upper heater power controller 140 will supply current to the upper heater element 100 for heating the upper volume 16 of the oven 10 and for maintaining the desirable temperature. The temperature sensor 118 will activate the lower oven temperature controller 144 to on and off conditions which, in turn, will activate the lower heater power controller 146 to on and off conditions. When activated, the lower heater power controller 146 will supply current to the lower heater element 40 for heating the lower volume 14 of the oven 10 and for maintaining the desirable temperature.

To use the enhanced heating structure feature of the oven 10, the on-off switches 122 and 124 need to be turned on and the adjustable knob 120 needs to be set at a desired oven temperature. The high voltage supply 88 will then generate a high voltage field between the flat plate 70 and the needle electrodes 36 which causes an increase in the rate of heat transfer from the heater element 40 to the flat plate 70. This increase in the rate of heat transfer decreases the cooking time relative to conventional ovens.

While a preferred embodiment of the invention has been shown and described herein, it is obvious that numerous additions, changes and omissions may be made in the embodiment without departing from the spirit and scope of the invention.

What is claimed is:

1. An enhanced heating structure for an oven having a bottom, a top, and sidewalls providing a housing comprising:

a platform supported on the bottom of the oven;

a plurality of spaced apart needle electrodes supported on said platform and projecting upward therefrom;

a heater element supported by the oven housing electrically isolated from and located adjacent said needle electrodes and connected to an electrical power supply;

an electrically conducting flat plate;

means on the oven housing supporting said flat plate above and spaced from and electrically insulated from said needle electrodes and said heater element, said means and said flat plate forming within the oven housing an enclosure of selected volume for enclosing said needle electrodes and said heater element; and means for generating a high voltage field between said flat plate and said needle electrodes for increasing the rate of heat transfer from said heater element to said flat plate.

2. The enhanced heating structure as claimed in claim 1 wherein said supporting means is a frame made from an electrical insulating material for electrically isolating said flat plate from the oven.

3. The enhanced heating structure as claimed in claim 2 wherein said frame is made from a ceramic material.

4. The enhanced heating structure as claimed in claim 1 wherein said generating means includes a high voltage power supply connected to said flat plate for generating said high voltage field in a direction from said needle electrodes to said flat plate.

5. The enhanced heating structure as claimed in claim 1 wherein said flat plate has a continuous smooth top surface.

6. The enhanced heating structure as claimed in claim 1, further including an upper platform supported on the top of said oven, a plurality of spaced apart needle electrodes supported on said upper platform and projecting downwardly therefrom; and an upper heating element electrically isolated and located adjacent upper needle electrodes and connected to said electrical power supply.

7. An oven for heating food comprising:

the oven having an upper volume and a lower volume;

an upper heating structure operable for heating said upper volume having a predetermined size to heat the food from above the food;

a lower heating structure operable for heating said lower volume having a predetermined size to heat the food from below the food, said lower heating structure having a plurality of electrodes in said lower volume, an electrically conducting flat plate supported above said electrodes, and means for generating a high voltage field between said flat plate and said plurality of electrodes; and control means for independently controlling said upper heating structure and said lower heating structure for providing heat according to the size of said upper volume relative to the size of said lower volume for heating the food substantially uniformly over its entire surface.

8. The oven as claimed in claim 7 wherein said control means includes a first temperature sensor for sensing temperature in said upper volume and a second temperature sensor for sensing temperature in said lower volume for independently maintaining a desired temperature in said lower volume relative to said upper volume.

9. The oven as claimed in claim 7 wherein the size of said upper volume is larger than the size of said lower volume, said upper heating structure being adapted to use a predetermined wattage for heating said upper volume, and said lower heating structure being adapted to use a wattage less than said predetermined wattage for heating said lower volume.

10. An oven having a bottom, a top, and sidewalls for heating food, said oven comprising:

an upper volume and a lower volume;

an upper heating structure operable for heating said upper volume to heat the feed from above the food;

a lower heating structure operable for heating said lower volume to heat the food from below the food;

said lower heating structure having a platform supported on the bottom of the oven;

a plurality of spaced apart needle electrodes supported on said platform and projecting upward therefrom;

a heater element electrically isolated and located adjacent said needle electrodes and connected to an electrical power supply;

an electrically conducting flat plate;

a non-electrically conducting frame supporting said flat plate above and spaced from said needle electrodes and said heater element, said frame and said flat plate enclose said needle electrodes and said heater element to form said lower volume;

means for generating a high voltage field between said flat plate and said needle electrodes for increasing the rate of heat transfer from said heater element to said flat plate; and control means for independently controlling said upper heating structure and said lower heating structure for providing heat according to the size of said upper volume relative to the size of said lower volume for heating the food substantially uniformly over its entire surface.

* * * * *